US010072645B2

(12) United States Patent
Inatani

(10) Patent No.: US 10,072,645 B2
(45) Date of Patent: Sep. 11, 2018

(54) PUMP

(71) Applicant: DENSO CORPORATION, Kariya, Aichi-pref. (JP)

(72) Inventor: Hiroki Inatani, Kariya (JP)

(73) Assignee: DENSO CORPORATION, Kariya (JP)

( * ) Notice: Subject to any disclaimer, the term of this patent is extended or adjusted under 35 U.S.C. 154(b) by 202 days.

(21) Appl. No.: 15/248,007

(22) Filed: Aug. 26, 2016

(65) Prior Publication Data

US 2017/0082094 A1 Mar. 23, 2017

(30) Foreign Application Priority Data

Sep. 18, 2015 (JP) ..... 2015-185563

(51) Int. Cl.

| | |
|---|---|
| ***F04B 19/22*** | (2006.01) |
| ***F02M 59/02*** | (2006.01) |
| ***F04B 9/04*** | (2006.01) |
| ***F04B 15/00*** | (2006.01) |
| ***F04B 17/05*** | (2006.01) |
| ***F04B 53/10*** | (2006.01) |
| ***F04B 53/14*** | (2006.01) |
| ***F04B 53/16*** | (2006.01) |
| ***F04B 53/18*** | (2006.01) |
| ***F04B 1/04*** | (2006.01) |
| ***F02M 59/10*** | (2006.01) |

(52) U.S. Cl.

CPC ..... *F04B 19/22* (2013.01); *F02M 59/025* (2013.01); *F02M 59/102* (2013.01); *F04B 1/0408* (2013.01); *F04B 1/0413* (2013.01); *F04B 1/0421* (2013.01); *F04B 9/04* (2013.01); *F04B 9/042* (2013.01); *F04B 15/00* (2013.01); *F04B 17/05* (2013.01); *F04B 53/10* (2013.01); *F04B 53/14* (2013.01); *F04B 53/16* (2013.01); *F04B 53/162* (2013.01); *F04B 53/18* (2013.01)

(58) Field of Classification Search

CPC .... F04B 1/0413; F04B 1/0408; F04B 1/0421; F04B 9/04; F04B 53/16; F04B 53/14; F04B 17/05; F02M 59/102; F02M 59/025

See application file for complete search history.

(56) References Cited

U.S. PATENT DOCUMENTS

| | | | | |
|---|---|---|---|---|
| 8,820,300 | B2 * | 9/2014 | Aritomi | F02M 59/102 123/495 |
| 9,115,713 | B2 * | 8/2015 | Oikawa | F02M 59/44 |
| 2012/0195779 | A1 | 8/2012 | Hishinuma et al. | |
| 2013/0206112 | A1 * | 8/2013 | Tamai | F02M 69/02 123/508 |

FOREIGN PATENT DOCUMENTS

JP 2014-077361 A 1/2014

* cited by examiner

*Primary Examiner* — Thomas E Lazo

(57) ABSTRACT

The present disclosure provides a pump including a cylinder, a plunger, a spring seat, a spring, and a stopper. The cylinder defines therein a cylinder hole. The plunger includes a shaft portion, a seat receiver, and a step surface. The spring biases the plunger in a second direction opposite to a first direction through the spring seat. The stopper includes an engaging portion. The engaging portion restricts, by engaging with the step surface, a movable range of the plunger in the second direction. The stopper defines therein an eccentric hole that has an inner diameter greater than an outer diameter of the step surface. The eccentric hole is eccentric with the plunger and opens through a portion of the stopper other than the engaging portion.

5 Claims, 11 Drawing Sheets

PUMP

CROSS REFERENCE TO RELATED APPLICATION

This application is based on reference Japanese Patent Application No. 2015-185563 filed on Sep. 18, 2015, the disclosure of which is incorporated herein by reference.

TECHNICAL FIELD

The present disclosure relates to a pump that pressurizes fluid by varying the volume of a pump chamber with reciprocal movement of a plunger.

BACKGROUND

Conventionally, there has been known a pump that moves a plunger in a first direction to pressurize fluid by a driving force applied to one end surface of the plunger in an axial direction. A seat receiver having a jaw shape is formed at the one end surface of the plunger to protrude radially outward of the plunger. A spring seat having a plate shape is attached to the plunger to engage with the seat receiver. The plunger is biased in a second direction opposite to the first direction by a biasing force of the spring through the spring seat.

A stopper is provided to prevent the plunger from falling from a cylinder hole when assembling the pump, or amounting the pump to an internal combustion engine.

Specifically, the plunger includes a large diameter portion and a small diameter portion. The large diameter portion is reciprocatably inserted into the cylinder hole and defines a pump chamber. The small diameter portion is positioned outside of the cylinder hole. A step surface is formed at a boundary region between the large diameter portion and the small diameter portion. The stopper has a cylindrical shape with a bottom, and a through hole is defined in the bottom for allowing the small diameter of the plunger to be inserted into the through hole. An engaging portion is formed around the through hole. The engaging portion engages with the step surface of the plunger.

The plunger is inserted into the cylinder hole and the stopper is fixed to the cylinder, and as a result, the step surface is engaged with the engaging portion, which prohibits the plunger from falling from the cylinder hole.

An outer diameter of the step surface needs to be greater than an inner diameter of the through hole. Therefore, the seat receiver and the small diameter portion are set to have diameters less than the through hole. After the seat receiver is inserted into the through hole, the small diameter portion is inserted into the through hole, and the plunger is moved until the step surface is brought into contact with the engaging portion.

A seat groove is formed at a boundary region of the seat receiver and the small diameter portion. The seat groove has a diameter less than the seat receiver. Then, the seat receiver is engaged with the seat groove by inserting the seat receiver into the seat groove (e.g., refer to Patent Literature 1: JP 2014-77361 A).

However, in the conventional pump, the diameter of the seat groove of the plunger is significantly less than the large diameter portion, and therefore the strength of the plunger may be decreased.

In view of the above, it is an objective of the present disclosure to provide a pump that includes a stopper to prevent a plunger from falling from a cylinder hole, where the strength of the plunger is increased.

SUMMARY

In an aspect of the present embodiment, a pump includes a cylinder, a plunger, a spring seat, a spring, and a stopper. The cylinder defines therein a cylinder hole. The plunger includes a shaft portion, a seat receiver, and a step surface. The shaft portion has a portion reciprocatably inserted into the cylinder hole to define a pump chamber. The seat receiver protrudes radially outward of the plunger and is arranged at a first side of the shaft portion opposite to a second side of the shaft portion that is close to the pump chamber. The step surface is formed at a middle portion of the shaft portion. The plunger is moved in a first direction to pressurize a fluid in the pump chamber by a driving force applied to an end surface of the first side of the shaft portion. The spring seat has a plate shape and engages with the seat receiver. The spring biases the plunger in a second direction opposite to the first direction through the spring seat. The stopper is fixed to the cylinder and includes an engaging portion. The engaging portion restricts, by engaging with the step surface, a movable range of the plunger in the second direction. The stopper defines therein an eccentric hole that has an inner diameter greater than an outer diameter of the step surface. The eccentric hole is eccentric with the plunger and opens through a portion of the stopper other than the engaging portion.

According to the above aspect, the portion of the shaft portion close to the pump chamber is inserted into the eccentric hole, and after the plunger is moved to a position where the step surface passes through the engaging portion, the plunger is moved in the radial direction, whereby the step surface can be engaged with the engaging portion.

In other words, the seat receiver does not pass through the eccentric hole. Therefore, the diameter of the seat receiver can be enlarged, and thus a seat groove in a conventional pump can be eliminated. As a result, the strength of the plunger can be increased.

BRIEF DESCRIPTION OF THE DRAWINGS

The above and other objects, features and advantages of the present invention will become more apparent from the following detailed description made with reference to the accompanying drawings. In the drawings.

DETAILED DESCRIPTION

As follows, a plurality of embodiments of the present disclosure will be described in detail. It is needless to say that the embodiments are some examples of the present disclosure, and therefore the present disclosure is not limited to these embodiment. Furthermore, each of the substantially same structures among the embodiments will be assigned to the respective common referential numeral and the description of the substantially same structures will be omitted in the subsequent embodiments

First Embodiment

A first embodiment will be described below. A pump according to the present embodiment is applied to a fuel supplying device that supplies fuel to a compression-ignition type internal combustion engine (hereinafter, referred to as an "engine"), more specifically, that supplies fuel such as diesel gasoline to a common rail while pressurizing the fuel.

Figure 1:
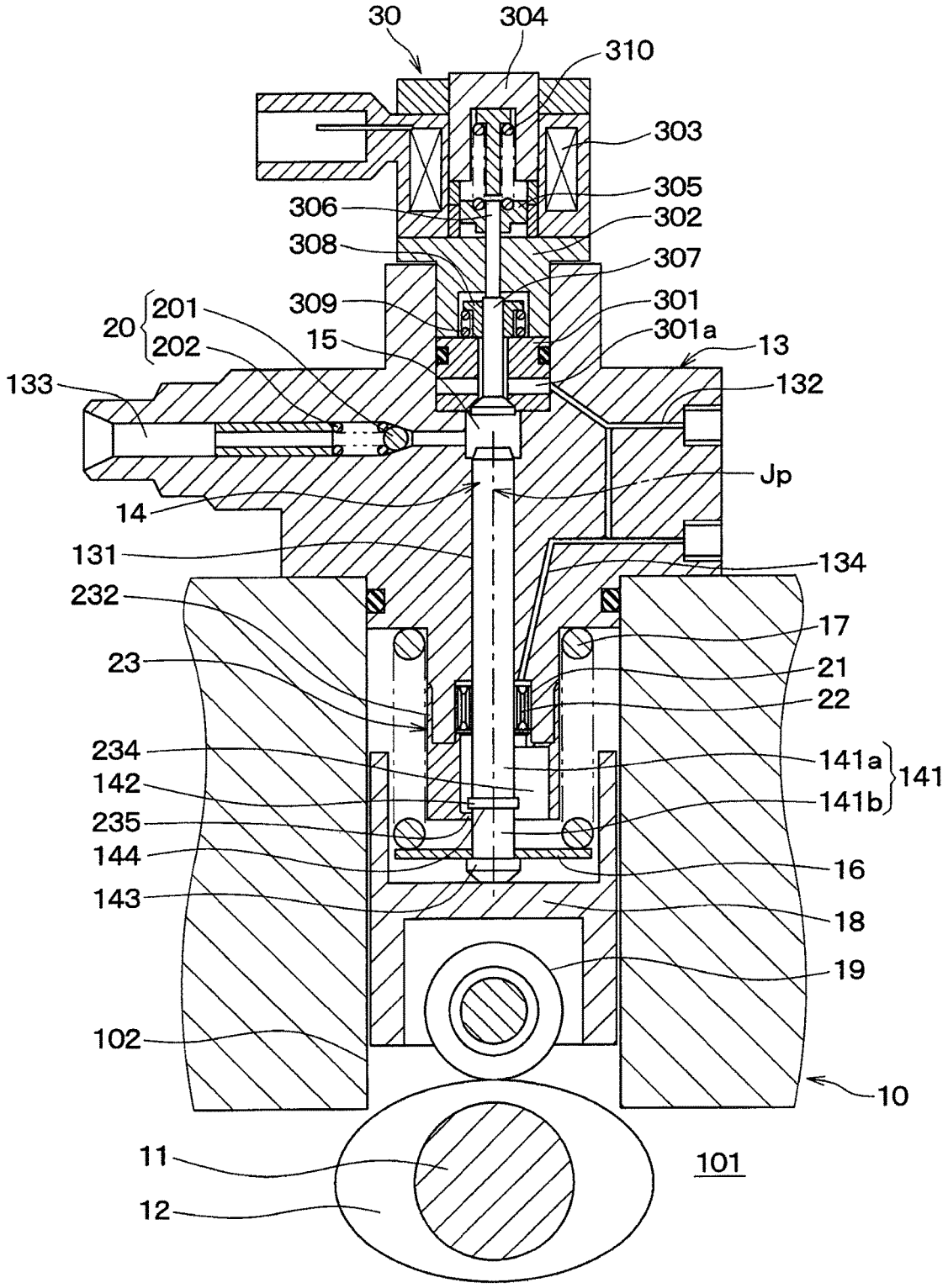
FIG. 1 is a cross-sectional view of a pump according to a first embodiment.

As shown in FIG. 1, the engine has a cylinder block 10. A cam chamber 101 is defined in the cylinder block 10 at a lower portion thereof. A cylinder block through hole 102 is also defined in the cylinder block 10. The cylinder block through hole 102 has a columnar shape and extends upward of the cylinder block 10 from the cum chamber 101. The cum chamber 101 and the cylinder block though hole 102 are filled with a lubricating oil to make a cum 12, a slider 18, a cum roller 19, and so on, which will be described later, smoothly move.

A cum shaft 11 driven by the engine is disposed in the cum chamber 11. The cum shaft 11 is rotatably supported in the cylinder block 10. The cum 12 is formed in the cum shaft 11.

A cylinder 13 formed of metal (such as SCN) is inserted into the cylinder block through hole 102 to cover an upper portion of the cylinder block through hole 102.

A cylinder hole 131 having a columnar shape is defined in the cylinder 13, and a plunger 14 having a columnar shape is reciprocatably inserted into the cylinder hole 131.

A pump chamber 15 having a columnar shape is defined by the plunger 14, the cylinder 13, and a first body 301 of a solenoid valve 30. The volume of the pump chamber 15 varies with reciprocation of the plunger 14.

The plunger 14 includes a shaft portion 141 having a columnar shape, a jaw portion 142 having a disk shape, and a seat receiver 143 having a disk shape. The shaft portion 141 has a columnar shape and extends along the reciprocating direction of the plunger 14. The jaw portion 142 is positioned at a middle portion of the shaft portion 141 in an axial direction and protrudes radially outward of the shaft portion 141. The seat receiver 143 is disposed at a first side of the shaft portion 141 opposite to a second side of the shaft portion 141 that is close to the pump chamber 15. The seat receiver 143 protrudes radially outward of the shaft portion 141.

The shaft portion 141 includes a first shaft 141*a* and a second shaft 141*b*. The first shaft 141*a* is a portion of the shaft portion 141 closer to the pump chamber 15 than the jaw portion 142 is to. The second shaft 141*b* is a portion of the shaft portion 141 further away from the pump chamber 15 than the jaw portion 142 is to.

The first shaft 141*a* has a portion reciprocatably inserted into the cylinder hole 131 and defines the pump chamber 15. The remaining portion of the first shaft 141*a* is positioned outside of the cylinder hole 131. The second shaft 141*b* is entirely positioned outside of the cylinder hole 131.

Figure 4:
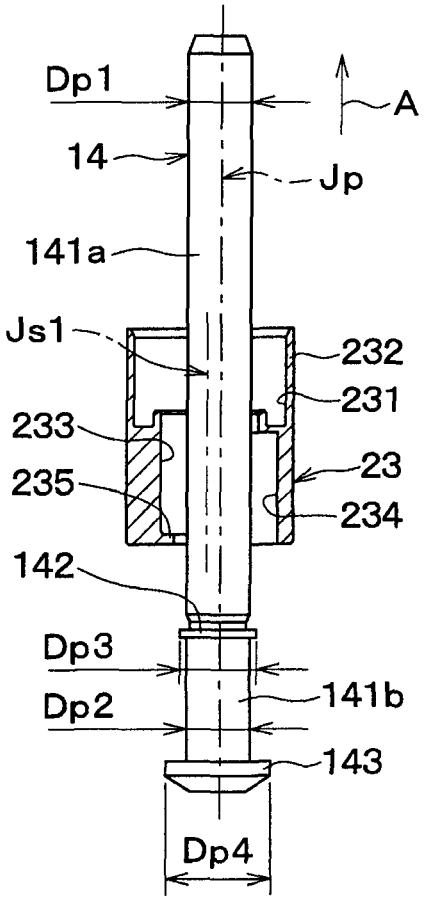
FIG. 4 is a cross-sectional view showing a first assembling process of a plunger and the stopper.

As shown in FIG. 4, the first shaft 141*a* has an outer diameter Dp1, the second shaft 141*b* has an outer diameter Dp2, the jaw portion 142 has an outer diameter Dp3, and the seat receiver 143 has an outer diameter Dp4. The Dp1, the Dp2, the Dp3, and the Dp4 satisfies $Dp1=Dp2<Dp3<Dp4$.

As shown in FIG. 1, a step surface 144 of the jaw portion 142 that is away from the pump chamber 15 has a flat surface perpendicular to an axial line Jp of the plunger 14.

The plunger 14 is moved in a first direction to pressurize fuel in the pump chamber 15 by reducing the volume of the pump chamber 15 by a driving force applied to an end surface of the first side of the shaft portion 141 that is away from the pump chamber 15.

A spring seat 16 having a disc shape is equipped with the plunger 14. The spring seat 16 is engaged with the seat receiver 143.

A spring 17 formed of a coil spring is interposed between the cylinder 13 and the spring seat 16. The plunger 14 is biased in a second direction opposite to the first direction by the spring 17 through the spring seat 16 and is pressed against the slider 18.

The slider 18 is formed into a cylindrical shape and is reciprocatably inserted into the cylinder block though hole 102. The cum roller 19 is rotatably attached to the slider 18 and the cum roller 19 is in contact with the cum 12. When the cum 12 rotates along with rotation of the cum shaft 11, the plunger 14 reciprocates together with the spring seat 16, the slider 18, and the cum roller 19.

The pump chamber 15 is in fluid communication with a fuel tank (not illustrated) through a through hole 301*a* defined in the first body 301 of the solenoid valve 30, a low pressure passage hole 132 defined in the cylinder 13, and an unillustrated low pressure fuel passage. A feed pump (not shown) is arranged in the low pressure fuel passage. The feed pump takes in fuel stored in the fuel tank and discharges the fuel at a low pressure. The fuel is supplied into the through hole 301*a* by the feed pump.

The pump chamber 15 is in fluid communication with the common rail through a high pressure passage hole 133 defined in the cylinder 13 and a high pressure fuel passage (not shown).

A discharging valve 20 is disposed in the high pressure passage hole 133. The discharging valve 20 includes a valve body 201 selectively opening and closing the high pressure passage hole 133 and a spring 202 biasing the valve body 201 in a closing direction. High pressure fuel pressurized in the pump chamber 15 moves the valve body 201 in an opening direction against a biasing force of the spring 202 and is supplied to the common rail with a high pressure.

A leak collecting groove 21 is formed at an end portion of the cylinder hole 131 away from the pump chamber 15. The leak collecting groove 21 collects a fuel leaked from a space between the plunger 14 and the cylinder 13. The leak collecting groove 21 is an annular groove formed by expanding an inner wall of the cylinder hole 131.

A plunger seal member 22 having a cylindrical shape is arranged in the leak collecting groove 21. The plunger seal member 22 prevents fuel from leaking into the cylinder block through hole 102 or the cum chamber 101 from the pump chamber 15 along an outer circumferential side of the plunger 14. Furthermore, the plunger seal member 22 prevents the fabricating oil from leaking into the pump chamber 15 from the cylinder block through hole 102 or the cum chamber 101.

The leak collecting groove 21 is fluidly connected to the fuel tank through a return hole 134 defined in the cylinder 13 and a fuel pipe (not illustrated). Accordingly, fuel flowing into the leak collecting groove 21 is returned to the fuel tank.

The solenoid valve 30 includes a first body 301 having a substantially cylindrical shape and a second body 302 having a substantially cylindrical shape. The first body 301 is arranged close to the cylinder 13 and is attached to the cylinder 13 so as to cover the pump chamber 15. The first body 301 is fixed to the cylinder 13 by screwing the second body 302 to the cylinder 13.

The solenoid valve 30 includes a coil 303 that generates a magnetic field when energized, a stator core 304 that generates an attraction force when the coil 303 is energized, an armature 305 that is attracted by the stator core 304 when the coil 303 is energized, and a rod 306 that is integrally formed with the armature 305. The rod 306 is slidably held by the second body 302.

The solenoid valve 30 includes a valve body 307, a spring seat 308, a first spring 309, and a second spring 310. The valve body 307 is in contact with the rod 306 and moves together with the armature 305 and the rod 306 to selectively open and close a space between the through hole 301*a* and the pump chamber 15. The spring seat 308 is integrally fit into the valve body 307. The first spring 309 biases the valve body 307 and the spring seat 308 toward the armature 305. The second spring 310 biases the armature 305 and the valve body 307 in a direction opposite to the direction of the attraction force. The valve body 307 is slidably held by the first body 301.

Figure 2:
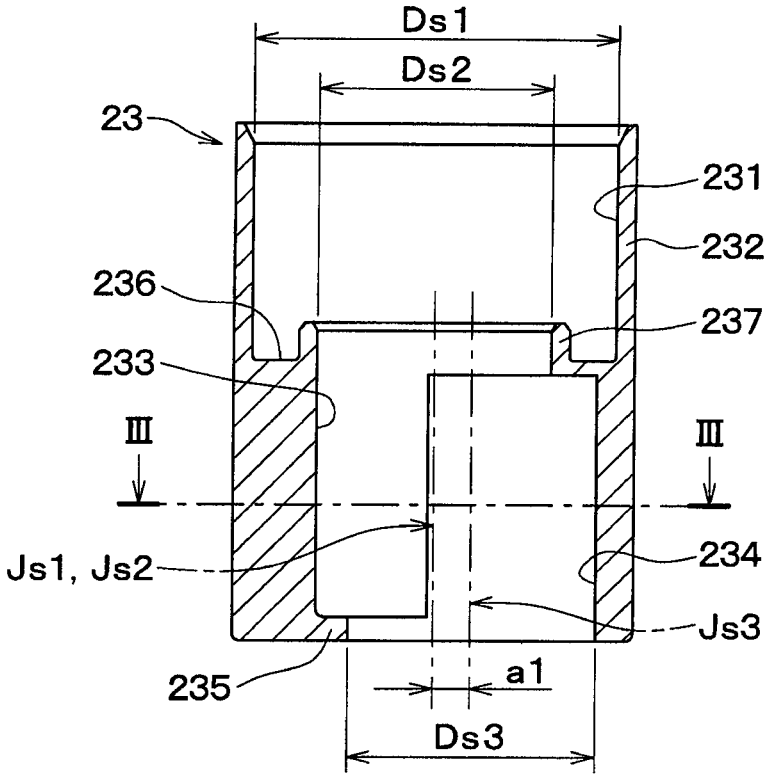
FIG. 2 is a cross-sectional view of a stopper according to the first embodiment.
Figure 3:
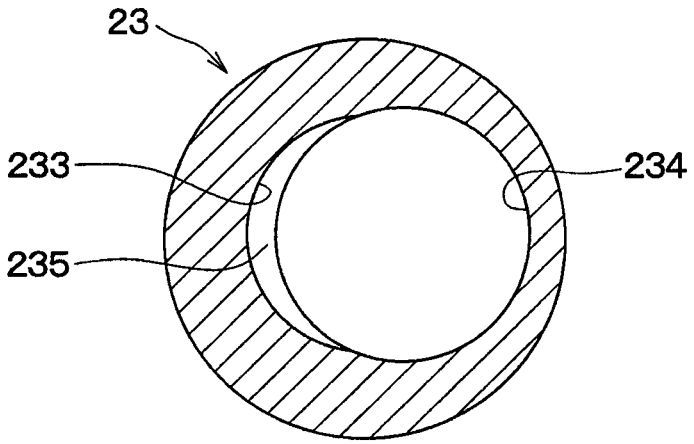
FIG. 3 is a cross-sectional view taken along III-III line in FIG. 2.

As shown in FIGS. 1 to 3, the stopper 23 is formed of, e.g., an alloy steel, or a carbon steel, and has a cylindrical shape with a bottom.

A fitting hole 231 is defined in the stopper 23. The fitting hole 231 extends from one end surface of the stopper 23 to a middle portion of the stopper 23 in the axial direction. A thinner portion of the stopper 23 around the fitting hole 231 serves as a joining cylindrical portion 232.

A center hole 233 is defined in the stopper 23. The center hole 233 extends from the middle portion of the stopper 23 toward the other end surface of the stopper 23 in the axial direction. The center hole 233 is coaxial with the fitting hole 231 and the plunger 14 and extends to a position prior to the bottom of the stopper 23. An inner diameter Ds2 of the center hole 233 is greater than the outer diameter Dp1 of the first shaft 141*a* and less than the inner diameter Ds1 of the fitting hole 231.

An eccentric hole 234 is defined in the bottom of the stopper 23. The eccentric hole 234 extends from the other end surface of the stopper 23 toward the middle portion of the stopper 23. The eccentric hole 234 extends to a position where the eccentric hole 234 is overlapped with the center hole 233.

The eccentric hole 234 is eccentric with the fitting hole 231, the center hole 233, and the plunger 14. A distance between an axial line Js1 of the fitting hole 231, an axial line Js2 of the center hole 233, or an axial line Jp of the plunger 14 and an axial line Js3 of the eccentric hole 234 is defined as a deviation a1. An inner diameter Ds3 of the eccentric hole 234 is less than Ds2+2*a1 and greater than the outer diameter Dp1 of the first shaft 141*a*. Accordingly, an engaging portion 235 having a crescent moon shape is formed in the bottom of the stopper 23. Due to the engagement between the engaging portion 235 and the step surface 144, the movable range of the plunger 14 in the second direction opposite to the first direction (i.e., a pressurizing direction) is restricted.

A positioning surface 236 having a disk shape is formed in the stopper 23 in the joining cylindrical portion 232 at the middle portion of the stopper 23. The positioning surface 236 is in contact with an end surface of the leak collecting groove 21 in the cylinder 13.

A seal pressing portion 237 having a thinner cylindrical shape is formed in the stopper 23 inside of the positioning surface 236. The seal pressing portion 237 protrudes from the positioning surface 236 toward the one end side of the stopper 23.

The stopper 23 may be formed through cutting process. More specifically, the fitting hole 231 and the center hole 233 are formed by end-milling, whereas the eccentric hole 234 may be formed by end-milling or drilling.

Next, an assembling process of the plunger 14 and the stopper 23 will be described below with reference to FIGS. 4 to 7. As shown in FIG. 4, the plunger 14 is moved in an insertion direction A and is inserted into the stopper 23 from the bottom (i.e., from the side of the eccentric hole 234). More specifically, after the tip end (i.e., the end side close to the pump chamber 15) of the first shaft 141*a* is inserted into the eccentric hole 234 without interfering with the engaging portion 235, the plunger 14 is moved in the insertion direction A, and the first shaft 141*a* is inserted into the fitting hole 231, the center hole 233, and the eccentric hole 234.

Figure 5:
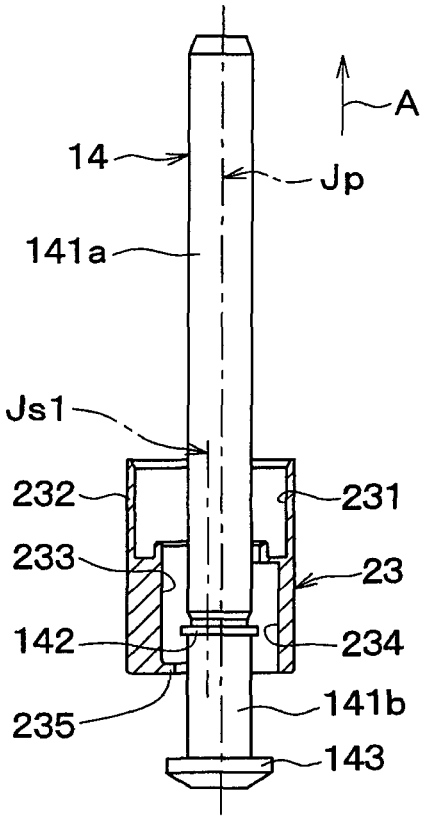
FIG. 5 is a cross-sectional view showing a second assembling process of the plunger and the stopper.

Next, as shown in FIG. 5, the plunger 14 is moved in the insertion direction A until the jaw portion 142 is inserted into the center hole 233 and the eccentric hole 234.

Figure 6:
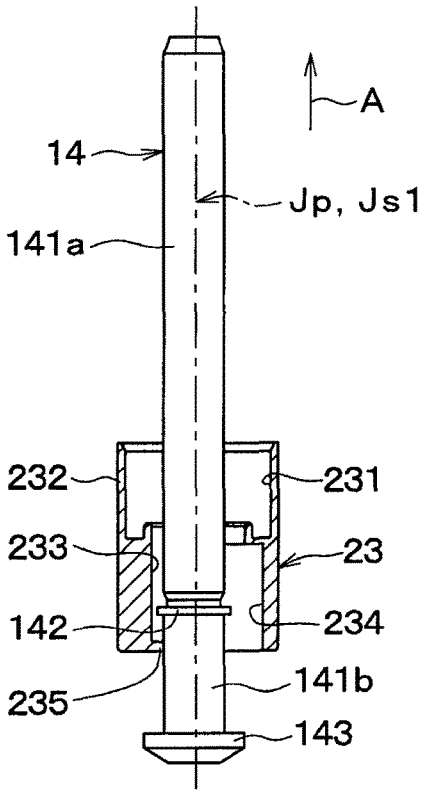
FIG. 6 is a cross-sectional view showing a third assembling process of the plunger and the stopper.

Then, as shown in FIG. 6, the plunger 14 is moved in a radial direction of the plunger 14 to have the jaw portion 142 face the engaging portion 235 in the axial direction.

Figure 7:
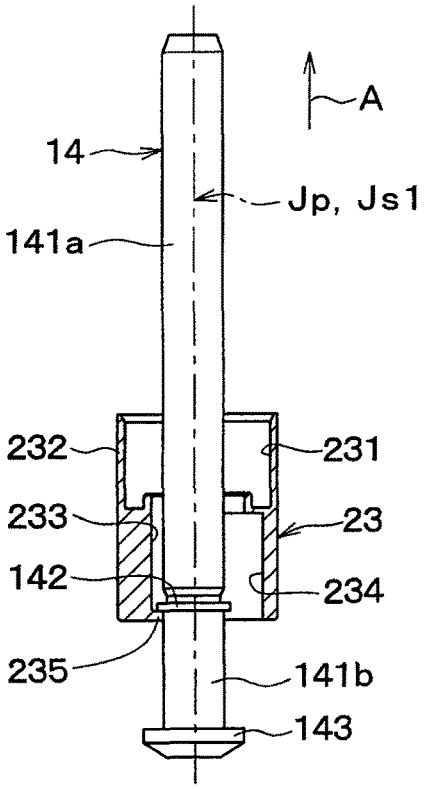
FIG. 7 is a cross-sectional view showing a fourth assembling process of the plunger and the stopper.

Thereafter, as shown in FIG. 7, the plunger 14 is moved in a direction opposite to the insertion direction A to have the step surface 144 brought in contact with the engaging portion 235, whereby the step surface 144 and the engaging portion 235 are engaged with each other.

As described above, when the plunger 14 is integrally inserted into the stopper 23, the seat receiver 143 does not pass through the eccentric hole 234.

Next, an attaching process of the plunger 14 and the stopper 23, that are integrally connected, to the cylinder 13 will be described with reference with FIG. 1.

Initially, the plunger seal member 22 is arranged in the leak collecting groove 21, and the spring seat 16 is attached to the plunger 14, and the spring 17 is arranged radially outward of the plunger 14 and the stopper 23 to be mounted on the spring seat 16.

At this point, the plunger 14 is inserted into the plunger seal member 22 and the cylinder hole 131, the end portion of the cylinder 13 close to the leak collecting groove 21 is fit into the joining cylindrical portion 232, and the seal pressing portion 237 (see FIG. 2) is inserted into the leak collecting groove 21. More specifically, the plunger 14 is inserted into the plunger seal member 22 and the cylinder hole 131 until the positioning surface 236 (see FIG. 2) is brought into contact with the leak collecting groove 21 in the cylinder 13. As a result, the plunger seal member 22 is held by the seal pressing portion 237 at a specified position.

Then, after the joining cylindrical portion 232 is fit to the cylinder 13, the stopper 23 is fixed to the cylinder 13. Specifically, the stopper 23 and the cylinder 13 are joined to each other by press-fitting, crimping, welding, or screws.

In this way, by fixing the stopper 23 to the cylinder 13, the plunger 14 can be prohibited from falling from the cylinder hole 131 through the engagement between the step surface 144 and the engaging portion 235.

Next, operation of the fuel supplying device will described. When the coil 303 of the solenoid valve 30 is not energized, the valve body 307 of the solenoid valve 30 is moved to an open position by a biasing force of the second spring 310, whereby the through hole 301*a* is in communication with the pump chamber 15.

In suction process where the plunger 14 moves downward while the through hole 301*a* is being in communication with the pump chamber 15, a low pressure fuel discharged from the feed pump is supplied to the pump chamber 15 through the low pressure passage hole 132 and the through hole 301*a*.

Next, in discharging process where the plunger 14 moves upward, the plunger 14 tries to pressurize fuel in the pump chamber 15. However, at an early stage after start of the rise of the plunger 14, the coil 303 is not energized, and the through hole 301*a* is in communication with the pump chamber 15. Therefore, fuel in the pump chamber 15 overflows into the through hole 301*a*, and thus is not pressurized.

When the coil 303 is energized during the overflow of the fuel in the pump chamber 15, the armature 305 is attracted by the stator core 304 against a biasing force of the second spring 310. The valve body 307 is biased by the first spring 309 to follow the armature 305. Then, the valve body 307 moves to a close position to close a space between the through hole 301*a* and the pump chamber 15.

Accordingly, the overflow of fuel toward the through hole 301*a* is stopped, and the plunger 14 starts pressurizing fuel in the pump chamber 15. Then, the discharging valve 20 is closed due to a pressure of fuel in the pump chamber 15, and thus fuel at a high pressure is supplied to the common rail.

As described above, when the plunger 14 is integrally inserted into the stopper 23, the seat receiver 143 does not pass through the eccentric hole 234. Therefore, the diameter of the seat receiver 143 can be increased, and therefore a conventional seat insertion groove of the pump can be eliminated, thereby increasing strength of the plunger 14.

Figure 8:
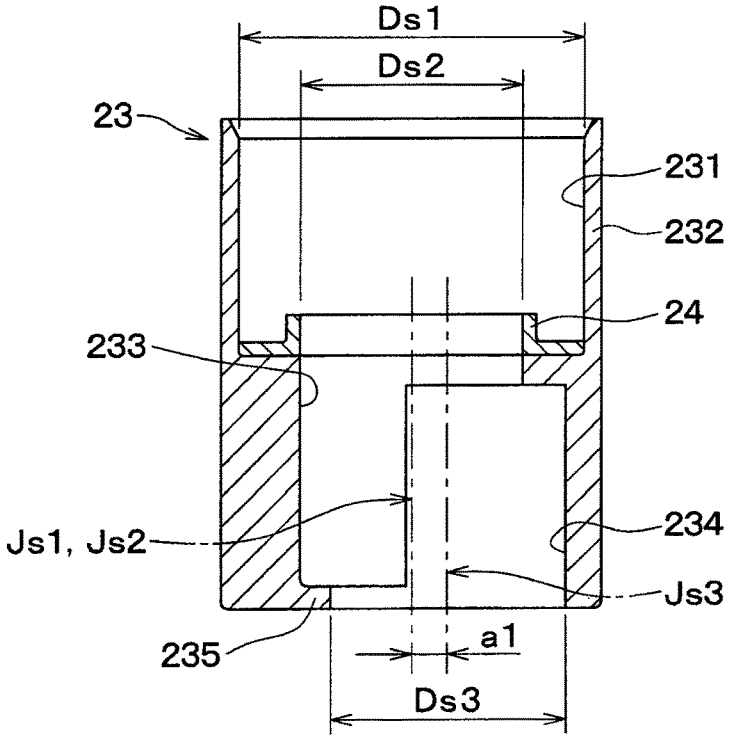
FIG. 8 is a cross-sectional view of a stopper according to a first modification to the first embodiment.

In the above-described embodiment, the seal pressing portion 237 is integrally formed with the stopper 23. Alternatively, FIG. 8 shows a first modification to the first embodiment where a seal pressing portion 24 having a cylindrical shape may be separately provided, and the seal pressing portion 24 may be attached to the stopper 23. In this way, by separately providing the seal pressing portion 24, machining process for the stopper 23 can be simplified. It should be noted that the seal pressing portion 24 can be formed by press-molding.

Figure 9:
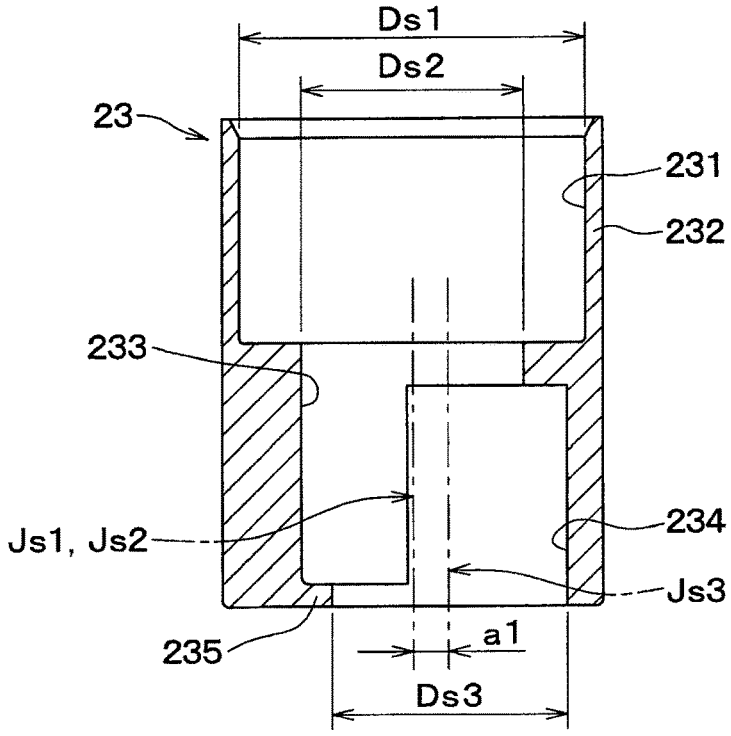
FIG. 9 is a cross-sectional view of a stopper according to a second modification to the first embodiment.

In the present embodiment, the seal pressing portion 237 is integrally formed with the stopper 23. Alternatively, FIG. 9 shows a second modification to the first embodiment, the seal pressing portion 237 may be eliminated.

Second Embodiment

Figure 10:
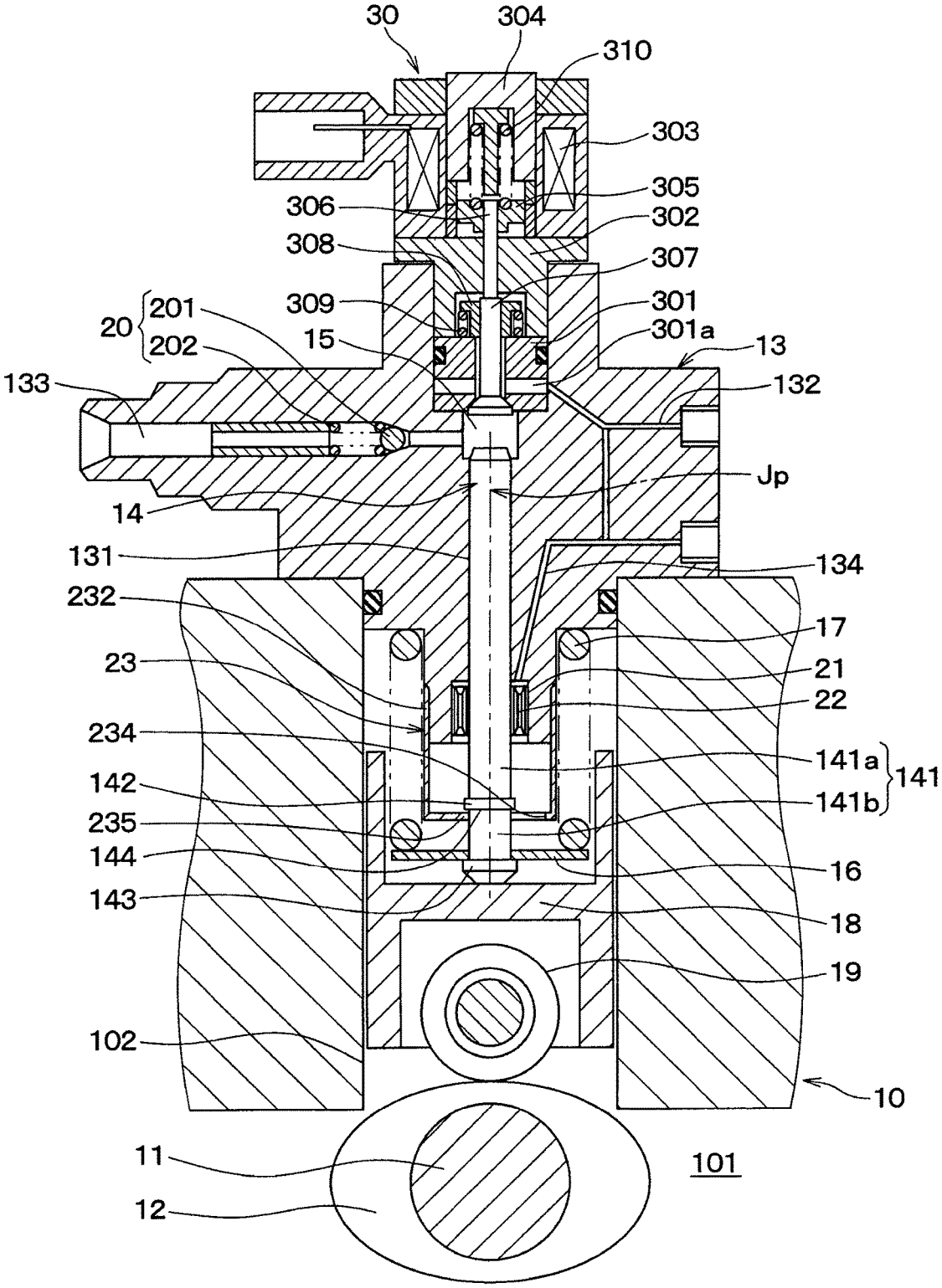
FIG. 10 is a cross-sectional view of a pump according to a second embodiment.
Figure 11:
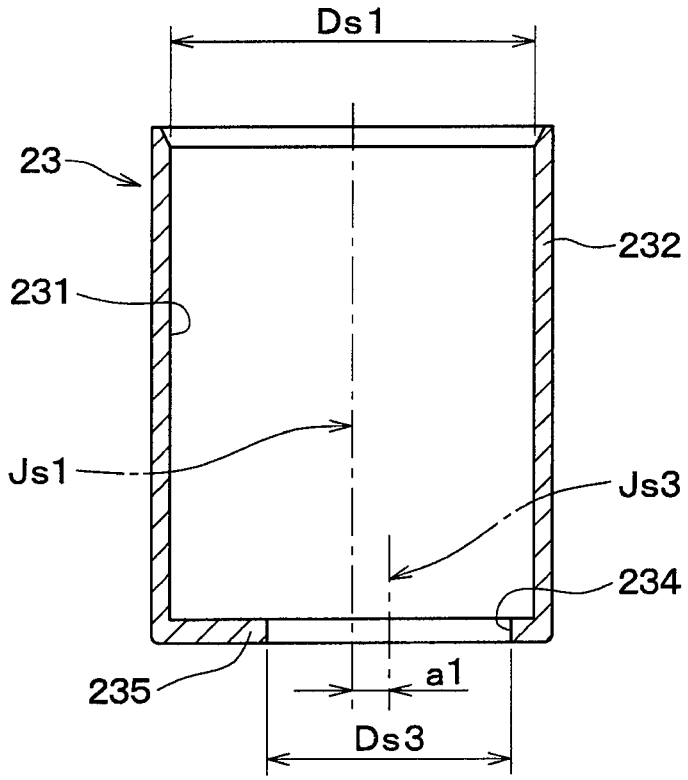
FIG. 11 is a cross-sectional view of the stopper according to the second embodiment.

With reference to FIGS. 10 and 11, the second embodiment will be described. In the present embodiment, the stopper 23 has a different configuration from the first embodiment.

As shown in FIGS. 10 and 11, the center hole 233, the positioning surface 236, and the seal pressing portion 237 are eliminated from the stopper 23.

The fitting hole 231 extends from the first end surface of the stopper 23 in the axial direction to the bottom of the stopper 23. The thinner portion of the stopper 23 around the fitting hole 231 serves as the joining cylindrical portion 232.

The eccentric hole 234 opens through the bottom of the stopper 23. The eccentric hole 234 is arranged to be eccentric with the fitting hole 231 and the plunger 14. The engaging portion 235 is formed in the bottom of the stopper 23.

In the present embodiment, the distance between the axial line Js1 of the fitting hole 231 or the axial line Jp of the plunger 14 and the axial line Js3 of the eccentric hole 234 is defined as a deviation a1.

The stopper 23 of the present embodiment can be formed by cutting process or press-molding. When press-molding is used, stainless alloy may be preferably used as material for the stopper 23.

Next, an assembling process for the plunger 14 and the stopper 23. The first shaft 141*a* is inserted into the stopper 23 from the bottom, and is moved until the jaw portion 142 is inserted into the fitting hole 231.

Then, the plunger 14 is moved in a radial direction of the plunger 14 to have the jaw portion 142 face the engaging portion 235 in the axial direction. Furthermore, the plunger 14 is moved in a direction opposite to the insertion direction to have the step surface 144 brought into contract with the engaging portion 235, whereby the step surface 144 and the engaging portion are engaged with each other.

In this way, when the plunger 14 is integrally inserted into the stopper 23, the seat receiver 143 does not pass through the eccentric hole 234.

After the plunger 14 is integrally inserted into the stopper 23, both the plunger 14 and the stopper 23 are fixed to the cylinder 13 as with the first embodiment. Then, after the stopper 23 is fixed to the cylinder 13, the plunger 14 can be prevented from fall from the cylinder hole 131 by the engagement between the step surface 144 and the engaging portion 235.

The present embodiment can achieve the same effects as the first embodiment.

Third Embodiment

Figure 12:
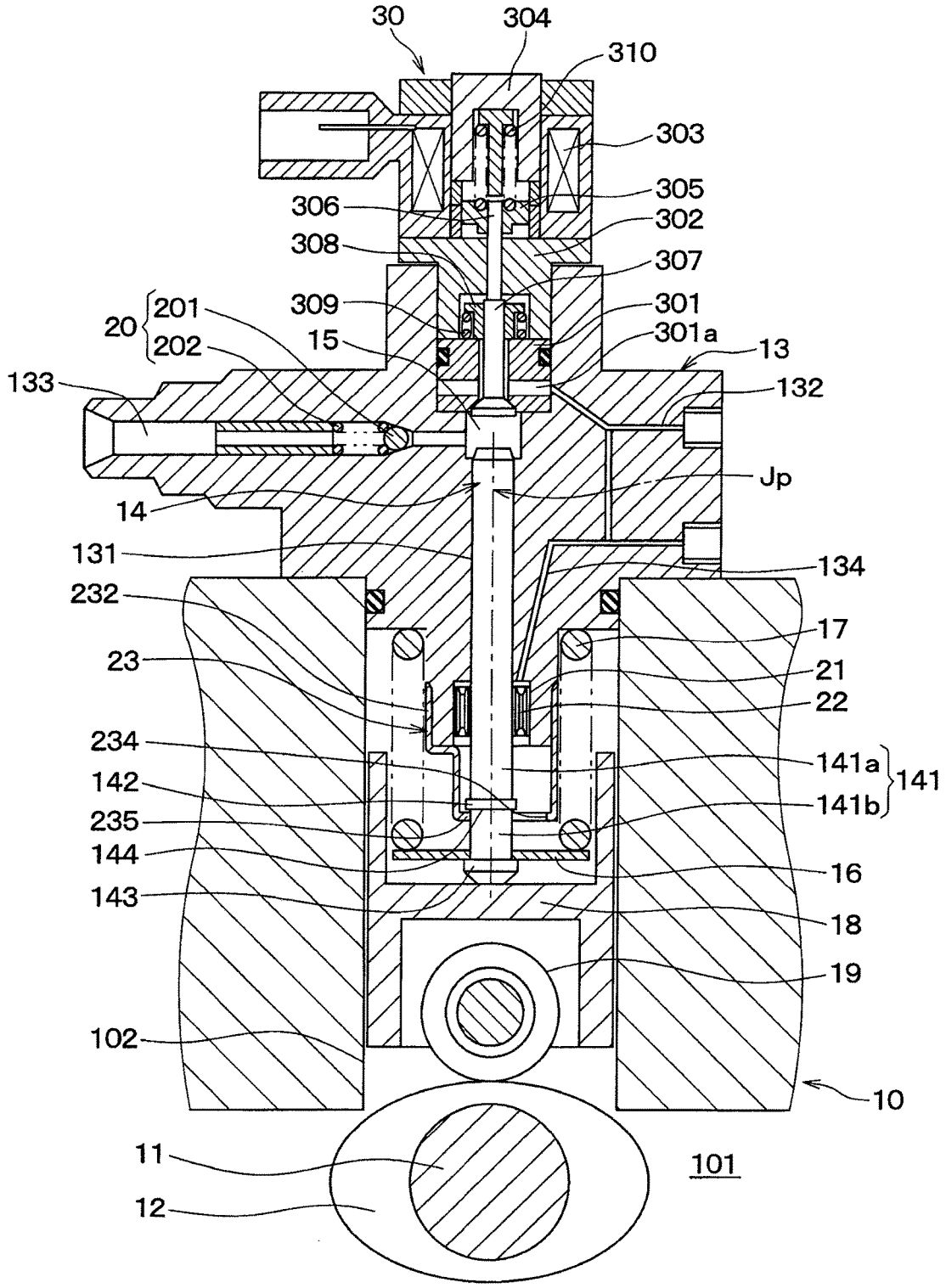
FIG. 12 is a cross-sectional view of a pump according to a third embodiment.
Figure 13:
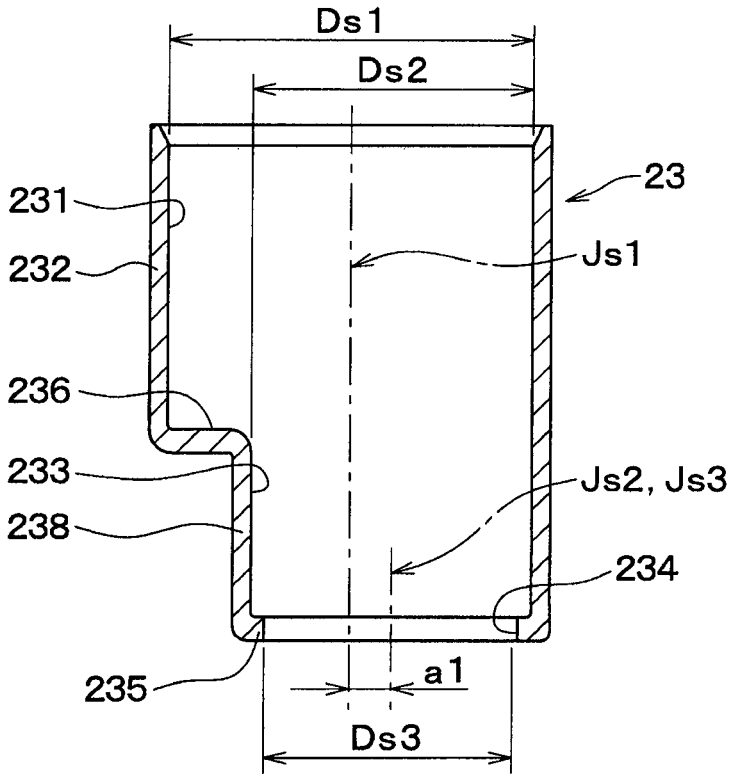
FIG. 13 is a cross-sectional front view of a stopper according to the third embodiment.
Figure 14:
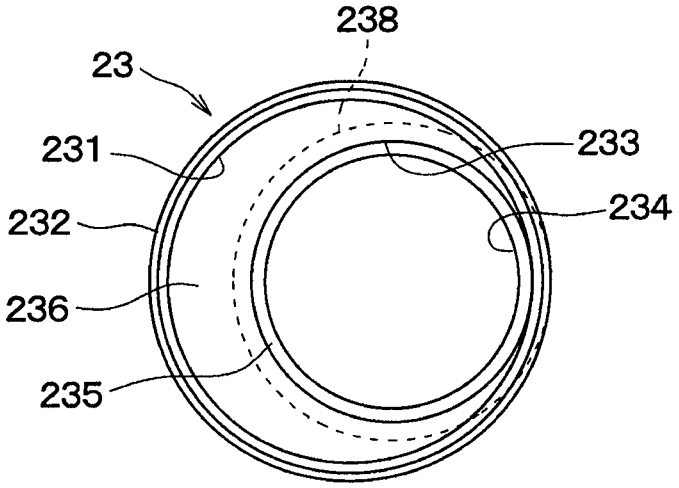
FIG. 14 is a plain view of the stopper according to the third embodiment.

With reference to FIGS. 12 to 14, the third embodiment will be described. In the present embodiment, the stopper 23 has a different configuration from the first embodiment.

In the present embodiment, the shape of the stopper 23 is modified to be suitable for press-molding. When press-molding is used, stainless alloy is preferably used as material of the stopper 23.

As shown in FIGS. 13 and 14, the seal pressing portion 237 is eliminated from the stopper 23.

The center hole 233 extends from the middle portion of the stopper 23 in the axial direction to the bottom of the stopper 23. The thinner portion of the stopper 23 around the center hole 233 serves as an eccentric cylindrical portion 238.

The center hole 233 and the eccentric hole 234 are coaxial with each other, and the center hole 233 and the eccentric hole 234 are eccentric with the fitting hole 231. Therefore, the eccentric cylindrical portion 238 is arranged to be eccentric with the joining cylindrical portion 232. In the present embodiment, the distance between the axial line Js1 of the fitting hole 231 or the axial line Jp of the plunger 14 and the axial line Js3 of the eccentric hole 234 is defined as a deviation a1.

The step portion (i.e., the boundary region between the eccentric cylindrical portion 238 and the joining cylindrical portion 232) formed by the eccentricity of the eccentric hole 238 from the joining cylindrical portion 232 serves as the positioning surface 236.

The eccentric hole 234 opens through the bottom of the stopper 23. The eccentric hole 234 has a diameter less than the inner diameter Ds2 of the center hole 233, and therefore the engaging portion 235 is formed in the bottom of the stopper 23 around the eccentric hole 234.

Next, an assembling process of the plunger 14 and the stopper 23 will be described. The first shaft 141*a* is inserted into the stopper 23 from the bottom, and the plunger 14 is moved until the jaw portion 142 is inserted into the center hole 233.

Next, the plunger 14 is moved in a radial direction of the plunger 14 to have the jaw portion 142 face the engaging portion 235 in the axial direction. Furthermore, the plunger 14 is moved in a direction opposite to the insertion direction to have the step surface 144 brought into contact with the engaging portion 235, whereby the step surface 144 and the engaging portion 235 are engaged with each other.

In this way, when the plunge 14 is integrally inserted into the stopper 23, the seat receiver 143 does not pass through the eccentric hole 234.

After the plunger 14 is integrally inserted into the stopper 23, both the plunger 14 and the stopper 23 are fixed to the cylinder 13 as the first embodiment. After fixing the stopper 23 to the cylinder 13, the plunger 14 can be prohibited from falling from the cylinder hole 131 by the engagement between the step surface 144 and the engaging portion 235.

The present embodiment can achieve the same effects as the first embodiment.

Fourth Embodiment

Figure 15:
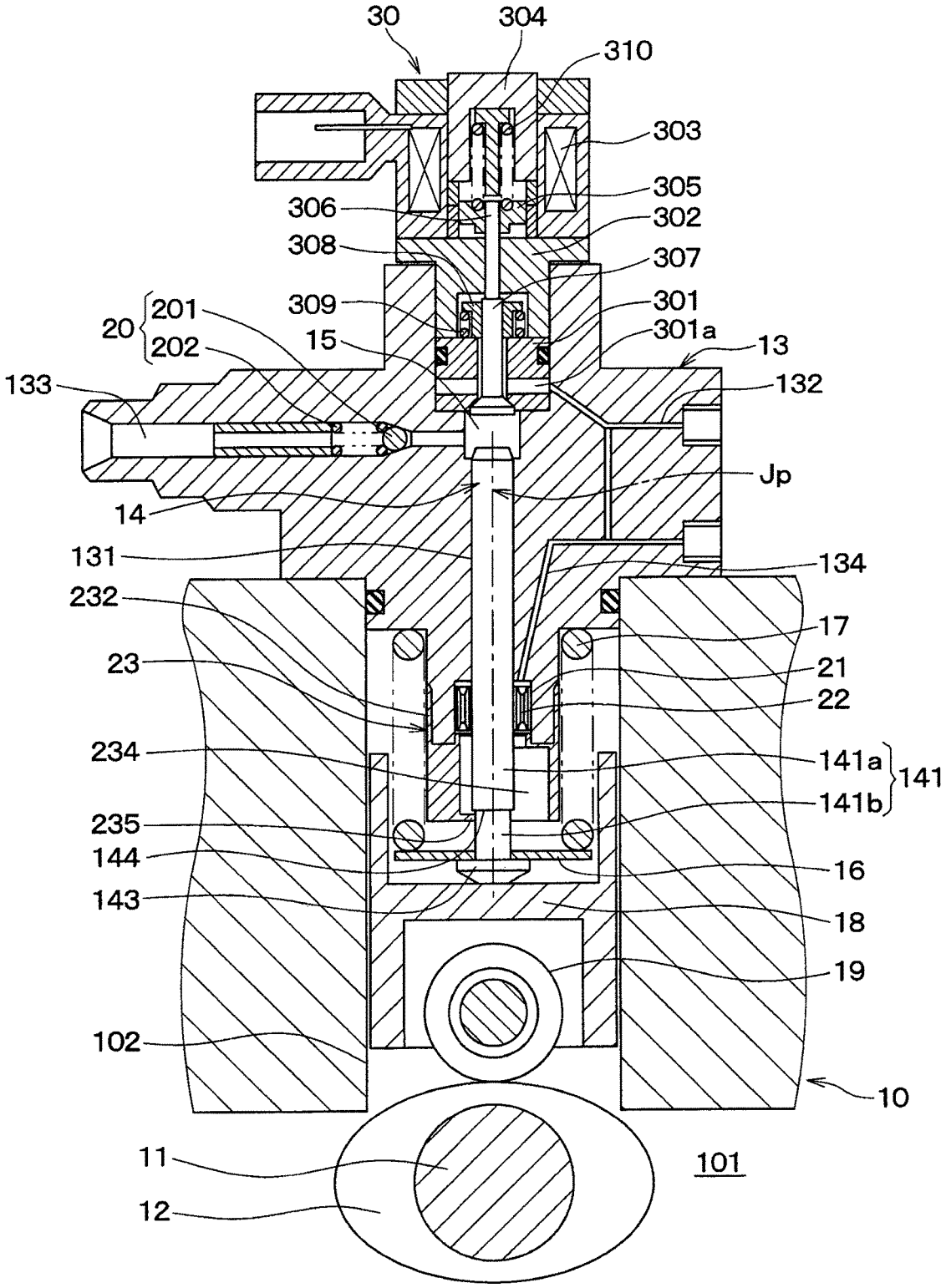
FIG. 15 is a cross-sectional view of a pump according to a fourth embodiment.
Figure 16:
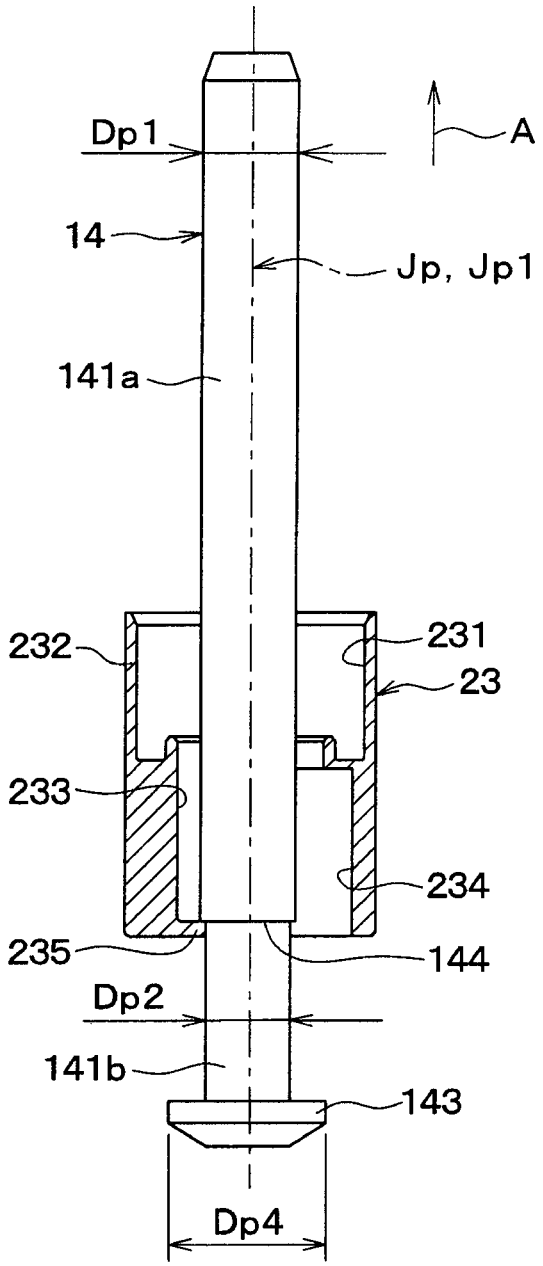
FIG. 16 is a cross-sectional view of a plunger and a stopper according to the fourth embodiment.

With reference to FIGS. 15 and 16, the fourth embodiment will be described. In the present embodiment, the plunger 14 has a different configuration from the first embodiment.

As shown in FIGS. 15 and 16, the jaw portion 142 is eliminated from the plunger 14.

The outer diameter Dp2 of the second shaft 141*b* is set to be less than the outer diameter Dp1 of the first shaft 141*a*. The first shaft 141*a* and the second shaft 141*b* are coaxial with each other. The boundary region between the first shaft 141*a* and the second shaft 141*b* serves as the step surface 144.

The outer diameter Dp4 of the seat receiver 143 is greater than the outer diameter Dp1 of the first shaft 141*a* and the outer diameter Dp2 of the second shaft 141*b*.

Next, an assembling process of the plunger 14 and the stopper 23 will be described. The first shaft 141*a* is inserted into the stopper 23 from the bottom and is moved until the step surface 144 is inserted into the center hole 233.

Thereafter, the plunger 14 is moved in the radial direction of the plunger 14 to have the step surface 144 face the engaging portion 235 in the axial direction. Then, the plunger 14 is moved in a direction opposite to the insertion direction A to have the step surface 144 brought into contact with the engaging portion 235, whereby the step surface 144 and the engaging portion 235 are engaged with each other.

In this way, when the plunge 14 is integrally inserted into the stopper 23, the seat receiver 143 does not pass through the eccentric hole 234.

After the plunger 14 is integrally inserted into the stopper 23, both the plunger 14 and the stopper 23 are fixed to the cylinder 13 as the first embodiment. After fixing the stopper 23 to the cylinder 13, the plunger 14 can be prohibited from falling from the cylinder hole 131 by the engagement between the step surface 144 and the engaging portion 235.

The present embodiment can achieve the same effects as the first embodiment.

Other Embodiments

In the above-described embodiments, the present disclosure is applied to the pump that pressurizes fuel such as diesel gasoline and supplies the pressurized fuel to the common rail. However, the present disclosure may be applied to other pumps.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

Example embodiments are provided so that this disclosure will be thorough, and will convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms and that neither should be construed to limit the scope of the disclosure. In some example embodiments, well-known processes, well-known device structures, and well-known technologies are not described in detail.

In the above-described embodiments, the elements forming each embodiment are not necessarily essential unless those are explicitly specified as essential elements or are clearly considered as essential elements.

The terminology used herein is for the purpose of describing particular example embodiments only and is not intended to be limiting. As used herein, the singular forms "a," "an," and "the" may be intended to include the plural forms as well, unless the context clearly indicates otherwise.

In the above-described embodiments, when the shape or the positional relationship of the elements are referred, those elements are not necessarily limited to the shape or the positional relationship unless otherwise explicitly specified or should be clearly limited to such a shape or positional relationship.

What is claimed is:

1. A pump comprising:

a cylinder that defines therein a cylinder hole;

a plunger that includes a shaft portion, a seat receiver, and a step surface, the shaft portion having a portion reciprocatably inserted into the cylinder hole to define a pump chamber, the seat receiver protruding radially outward of the plunger and being arranged at a first side of the shaft portion opposite to a second side of the shaft portion that is close to the pump chamber, the step surface being formed at a middle portion of the shaft portion, the plunger being moved in a first direction to pressurize a fluid in the pump chamber by a driving force applied to an end surface of the first side of the shaft portion;

a spring seat that has a plate shape and engages with the seat receiver;

a spring that biases the plunger in a second direction opposite to the first direction through the spring seat; and a stopper that is fixed to the cylinder and includes an engaging portion, the engaging portion restricting, by engaging with the step surface, a movable range of the plunger in the second direction, wherein the stopper defines therein an eccentric hole that has an inner diameter greater than an outer diameter of the step surface, and the eccentric hole is eccentric with the plunger and opens through a portion of the stopper other than the engaging portion.

2. The pump according to claim 1, wherein the stopper is formed of a cylindrical portion and a bottom, and the engaging portion and the eccentric hole are formed in the bottom of the stopper.

3. The pump according to claim 2, wherein the cylindrical portion of the stopper is joined to the cylinder.

4. The pump according to claim 1, wherein the shaft portion includes a jaw portion that protrudes radially outward of the shaft portion and that has an end surface serving as the step surface.

5. The pump according to claim 1, wherein the shaft portion includes a first shaft and a second shaft, the first shaft has a portion reciprocatably inserted into the cylinder hole, the second shaft is positioned outside of the cylinder hole and has a diameter less than that of the first shaft, and the first shaft and the second shaft are connected at a boundary region that forms the step surface.

* * * * *